US005540164A

United States Patent [19]

Grantham et al.

[11] Patent Number: 5,540,164

[45] Date of Patent: Jul. 30, 1996

[54] WORKPIECE POSITIONING APPARATUS

[75] Inventors: John W. Grantham, Syston; Paul M. Taylor; Gaynor E. Taylor, both of Goxhill; James M. Gilbert, Hull, all of United Kingdom

[73] Assignee: British United Shoe Machinery Limited, Leicester, England

[21] Appl. No.: 392,824

[22] PCT Filed: Aug. 31, 1993

[86] PCT No.: PCT/GB93/01839

§ 371 Date: Feb. 28, 1995

§ 102(e) Date: Feb. 28, 1995

[87] PCT Pub. No.: WO94/05843

PCT Pub. Date: Mar. 17, 1994

[30] Foreign Application Priority Data

Sep. 1, 1992 [GB] United Kingdom ..... 9218657

[51] Int. Cl.[6] ..... D05B 27/10

[52] U.S. Cl. ..... 112/306; 112/318; 112/322

[58] Field of Search ..... 112/30, 31, 28, 112/47, 51, 60, 62, 153, 318, 322, 306, 308

[56] References Cited

U.S. PATENT DOCUMENTS 4,653,414 3/1987 Harrington ..... 112/322 X 4,825,787 5/1989 Babson et al. ..... 112/153 X 5,031,552 7/1991 Hansberry ..... 112/153 X 5,033,399 7/1981 Miyachi et al. ..... 112/306 X

FOREIGN PATENT DOCUMENTS 1136687 5/1989 Japan ..... 112/153

*Primary Examiner*—Ismael Izaguirre

[57] ABSTRACT

Two workpiece portions (30, 32) that are to be stitched together along a stitching path (28) each have a stitching region (24, 26) which corresponds to the stitching path (28), but which is so shaped that the regions do not overlap when the workpieces (30, 32) are in a substantially flat condition. Thus some three-dimensional shaping is imparted to the portions during stitching. Each of the workpiece portions (30, 32) is clamped between two rollers (10, 12, 24) one of which is driven and the other freely rotatable, the driven rollers (10, 12) serving to distort the stitching regions into a desired overlapping position progressively in preparation for each successive stitching operation. The rollers are also bodily movable to advance the workpiece portions (30, 32) step-by-step through the operating locality (4) of the sewing machine. For sensing when the stitching regions are in the desired overlapping relationship suitable edge sensing means (40, 42, 44) is provided.

11 Claims, 7 Drawing Sheets

WORKPIECE POSITIONING APPARATUS

DESCRIPTION

1. Technical Field

The invention relates to workpiece positioning apparatus whereby two workpiece portions can be positioned with selected regions thereof in a desired relationship, e.g. an overlapping relationship, and be progressively advanced, in said relationship, through an operating locality of a machine by which said selected regions are progressively treated, e.g. a sewing machine at the operating locality of which a reciprocable needle is located for effecting a progressive sewing operation along said regions, the apparatus comprising workpiece support means for supporting the workpiece portions, workpiece clamping means co-operable with the workpiece support means for clamping the workpiece portions in the desired overlapping relationship, and advancing means for advancing the workpiece portions, clamped as aforesaid in said relationship, along a desired path through said operating locality.

2. Background Art

It is advantageous in the manufacture of certain three-dimensional articles, e.g. shoe uppers, to sew the constituent workpiece portions of the article together in a manner that results in the formation of a three-dimensional construction. This manner of stitching, commonly known as "sprung stitching", is adopted because it imparts a preliminary shape to the sewn article which facilitates the ultimate shaping by stretching the article around a former, which in the case of shoe uppers would be a last.

Whereas in general the feeding of workpiece portions through the operating locality of a treatment machine, e.g. a sewing machine, is relatively straightforward when the portions are "in the flat", difficulties arise in the case of sprung stitching, essentially because the selected regions to be sewn together will each have a stitching region which, while corresponding to the desired stitching path along which the portions are to be sewn, is shaped such that it does not overlap the region of the other portion along the whole of its length when the workpiece portions are in a substantially flat condition.

The two stitching regions must of course overlap at the time they are presented to the needle in order to ensure that the workpiece portions are sewn accurately together along the desired stitching path. One known method of ensuring that the stitching regions are accurately aligned is to deform and temporarily secure the workpiece portions together as a pre-assembly prior to presentation to the needle. When thus secured in this deformed condition the workpiece portions can be sewn together along the desired stitching path without any further need for positional adjustment of either of them. This method is, however, time-consuming because the deforming and temporarily securing operation is essentially a manual one.

Alternatively, the workpiece portions may be advanced to the operating locality of the machine and the operator must ensure that they are progressively deformed to bring the regions into overlapping relationship as they are fed. In such a case, reliance is thus placed solely on the skill of the operator and the task is time-consuming and requires considerable and sustained concentration.

THE INVENTION

It is an object of the present invention to overcome the problems associated with the known methods of preparing two workpiece portions of the type referred to above for presentation to the operating locality of the treatment machine. This object is resolved in accordance with the present invention, in an apparatus as set out in the first paragraph above, in that, for enabling workpiece portions to be treated having selected regions which do not match one another along the whole of their length when the portions are in a substantially flat condition, the workpiece clamping means comprises two elements, one engageable with each of the workpiece portions, by each of which elements movement of the workpiece portion engaged thereby can be effected transversely of said path, while the portion remains clamped as aforesaid, thus to bring the regions progressively into the desired relationship at said operating locality, and in that drive means is provided for effecting such movement of the elements.

It will thus be appreciated that in using the apparatus in accordance with the invention, as the workpiece portions are progressively advanced through the operating locality the relationship between the selected regions of the portions is varied, also progressively, to bring the regions into the desired relationship at the operating locality with the result that they can then be treated at said locality while held in that relationship. In this way despite the fact that, when the portions are overlaid "in the flat" the selected regions do not lie in the desired relationship along the whole of their length, they can nevertheless be brought into the desired relationship progressively and be treated while in this relationship.

Preferably in the apparatus in accordance with the invention each element of the workpiece clamping means is constituted by a conical roller rotatable about an axis. (The term "conical" where used herein in relation to rollers is to understood as including frusto-conical rollers.) Moreover in such a case the two axes intersect with each other at said operating locality. By using conical rollers each workpiece portion can be reliably clamped against the workpiece support means along a line contact while at the same time it can be rotated, effectively about an axis located at the operating locality, and thus effectively at the last treatment point along the length of the selected regions, such rotation bringing the selected regions into the desired relationship for them to be treated at the next-following treatment point.

Although in some instances it may be advantageous or desirable for the workpiece support means to be constituted by a flat support member having a low-friction surface, it has been found generally convenient to provide that the workpiece support means also comprises two conical rollers, one associated with each of the rollers of the workpiece clamping means, each roller being rotatable about an axis. Again in such case the two axes intersect with each other and with the axes of the rollers of the workpiece clamping means at said operating locality. In this way the line contact between the support and clamping surfaces (rollers) is maintained, while allowing for enhanced accessibility to both sides of the workpiece portions.

Preferably, furthermore, the rollers of the workpiece support means are freely rotatable, so that the risk of distortion of the workpiece portion by both sets of rollers being driven can be avoided, while also avoiding the need to synchronise the drive to the two sets.

For determining when, as the workpiece portions are progressively advanced, the selected regions are in their desired relationship, the apparatus in accordance with the invention preferably further comprises sensing means for detecting edges of the workpiece portions, said means controlling operation of the drive means whereby under the control of the sensing means the selected regions of the workpiece portions are brought progressively into the desired relationship. The sensing means may be of any suitable form, e.g. mechanical, but preferably is optical and comprises a plate member interposed between, but projecting from between, each of the workpiece portions "upstream" of said operating locality, which member has a surface reflectivity different from that of the workpiece portions and two emitter/receivers, one associated with each workpiece portion, co-operable with projecting portions of the plate member to enable the edges of the workpiece portions to be detected thereby.

In one particular embodiment of the invention the apparatus is constructed and arranged to position selected regions of two workpiece portions for a sewing operation to be performed thereon, in which case a reciprocable needle is located at the operating locality of the machine. In such case preferably the drive means is actuated in timed relation with reciprocation of the needle of the sewing machine, whereby transverse movement of the portions is effected while the needle is in penetrating engagement therewith, while the advancing means is also actuated in timed relation with reciprocation of the needle, whereby the portions are advanced while the needle is out of penetrating engagement therewith.

In this way, it will be appreciated, the needle, located at the last-formed stitch point, provides a centre about which the workpiece portions can be rotated to bring the selected regions into the desired overlapping relationship for the next stitch point and then, with the portions clamped in said relationship, the needle is withdrawn, the workpiece portions are advanced and the next stitch is then formed at the said next stitch point.

Preferably the portions are advanced step-by-step by the advancing means, each step representing one stitch length. To this end, moreover, conveniently the workpiece support means and the workpiece clamping means are mounted for movement towards and away from one another, whereby to cause the workpiece portions disposed therebetween to be clamped as aforesaid and unclamped, and are also mounted each on a carriage, for advancing and return movement in a direction along said path, such advancing movement being effected with the workpiece portions clamped as aforesaid, thus to cause them to be advanced, and such return movement being effected with the portions unclamped but with the needle in penetrating engagement therewith.

In the particular embodiment referred to above the axes of the conical rollers intersect the axis along which the needle reciprocates at the time when the latter is in penetrating engagement with the workpiece portions.

In using the apparatus in accordance with the invention, e.g. the particular embodiment referred to above, once the workpiece portions have been clamped between the rollers of the workpiece support means and the workpiece clamping means, no further manual intervention is required; the selected regions of the workpiece portions are automatically aligned by the workpiece clamping rollers and advanced, step by step, to the operating locality at which they are treated, e.g. stitched together, to produce a finished article. It will be appreciated that the automatic alignment of the selected regions of the workpiece portions represents a significant time-saving as compared to the procedures previously practised, e.g. in the case of the pre-assembling operation or the like.

There now follows a detailed description, to be read with reference to the accompanying drawings, of one workpiece positioning apparatus in accordance with the invention. It will be appreciated that this apparatus has been selected for description merely by way of non-limiting example.

THE ACCOMPANYING DRAWINGS

BEST MODE

Figure 1:
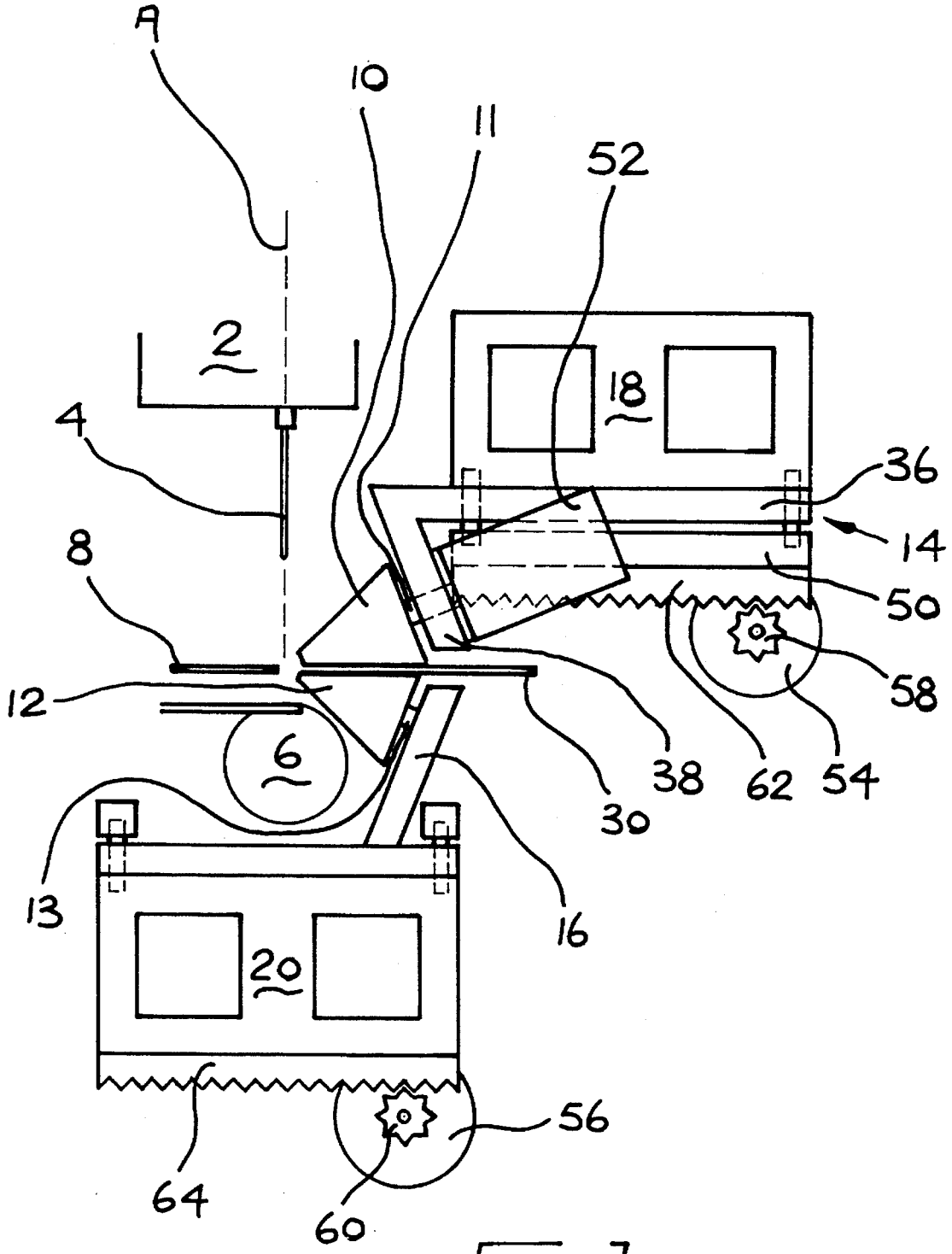
FIG. 1 is a schematic side view of the workpiece positioning apparatus in accordance with the invention, shown in its operative position in relation to sewing instrumentalities of a sewing machine.

The workpiece positioning apparatus in accordance with the invention now to be described is constructed and arranged to operate in conjunction with a sewing machine having a sewing head 2 (FIG. 1) supporting a conventional reciprocable sewing needle 4, and a workpiece support table 8 arranged at the out-feed side of the sewing needle 4 (workpieces as they are sewn together being advanced from right to left, viewing FIG. 1). Below the support table 8 is housed a bobbin 6 that cooperates with the needle 4 in a conventional manner. The needle 4 is mounted for reciprocation along an axis A, which lies in the plane of FIG. 1.

The workpiece positioning apparatus, illustrated in FIG. 1 in an operative position in relation to the sewing head, has a frame (not shown) supporting an upper carriage 18 and a lower carriage 20. The upper carriage 18 is mounted on a support 50 for heightwise movement relative to the lower carriage 20 under the action of a pneumatic motor (not shown), for reasons to be discussed below.

Secured to the upper carriage 18 are two cranked upper supporting arms 14 (one only shown in FIG. 1). The arms 14 are spaced apart, with one arm to either side of a plan which is parallel to the plane of FIG. 1. Each arm 14 has a horizontal portion 36 and a generally downwardly extending portion 38 inclined to the vertical At the lower end of each arm 14 is supported on a pin 11 a frusto-conical roller, respectively 10 and 22, forming part of workpiece clamping means of the apparatus. The apparatus also comprises drive means in the form of, for each roller 10 (22), a stepper motor 52 by which the roller is caused to rotated bout its axis 11.

Secured to the lower carriage 20 are two lower supporting arms 16 (one shown in FIG. 1). The lower supporting arms are spaced apart, with one arm to either side of the plane parallel to that of FIG. 1. Each arm 16 extends generally upwards, but inclined to the vertical. At the upper end of each arm 16 is supported on a pin 13 a frusto-conical roller, respectively 12 and 34, forming part of workpiece support means of the apparatus. The support rollers 12, 34 which are arranged to co-operate each with one of the rollers 10, 22, are freely rotatable.

The rollers 10, 12 shown in FIG. 1 are depicted in an operative position, in which a workpiece portion 30 is clamped therebetween for presentation to the needle 4 just above the level of the out-free table 8. The rollers 22, 34 not shown in FIG. 1 similarly serve to clamp a second workpiece portion 32. The inclinations of the supporting arms 14, 16 are such that, in their operative position, the axes of rotation of the rollers (i.e. the axes of the pins 11, 13) intersect with one another and with the axis of reciprocation A of the needle 4.

Figure 3:
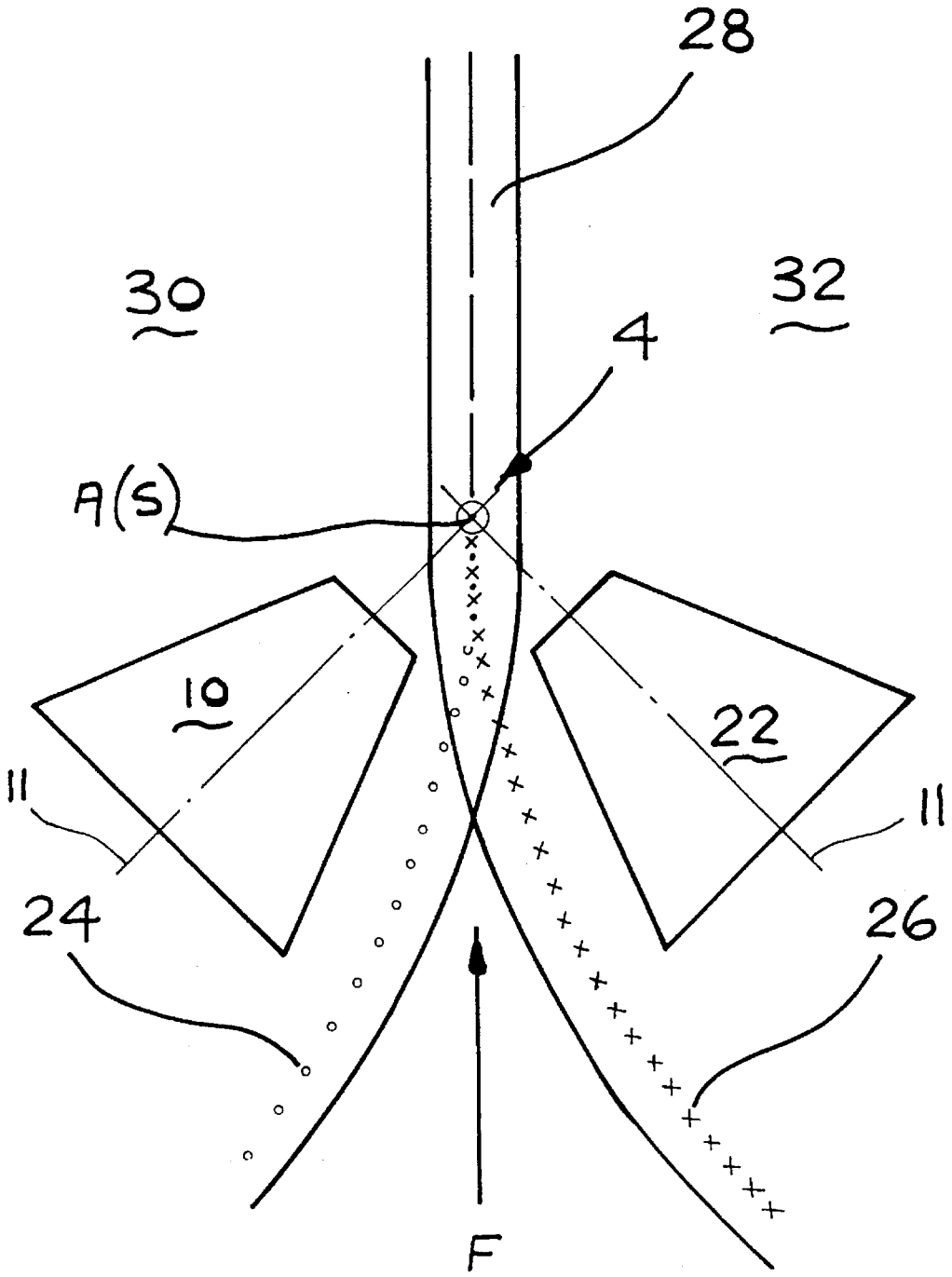
FIG. 3 is a schematic plan view of two workpiece portions being sewn together whilst clamped as aforesaid.

The set of rollers 10, 12 shown in FIG. 1 and the set thereof 22, 34 not shown in said Figure are arranged one at each side of a stitching path 28 (FIG. 3). This stitching path intersects the axis A at right angles. For advancing the workpiece portions to the needle 4 of the sewing machine advancing means in the form of synchronised stepping motors 54, 56 is provided, said motors being associated respectively with the support 50 for the upper carriage 18 and with the lower carriage 20. More particularly the motors 54, 56 each carry on their output shaft a pinion, respectively 58, 60, which meshes with a rack, respectively 62, 64, secured to the support 50 and lower carriage 20 respectively. By the synchronised operation of the motors 54, 56 the arms 14, 16 and the rollers 10, 12, 22, 34 supported thereby can be moved forwardly and rearwardly along a workpiece feed direction indicated by the arrow F (FIG. 3), as will be explained in greater detail below with reference to FIG. 5.

Figure 2:
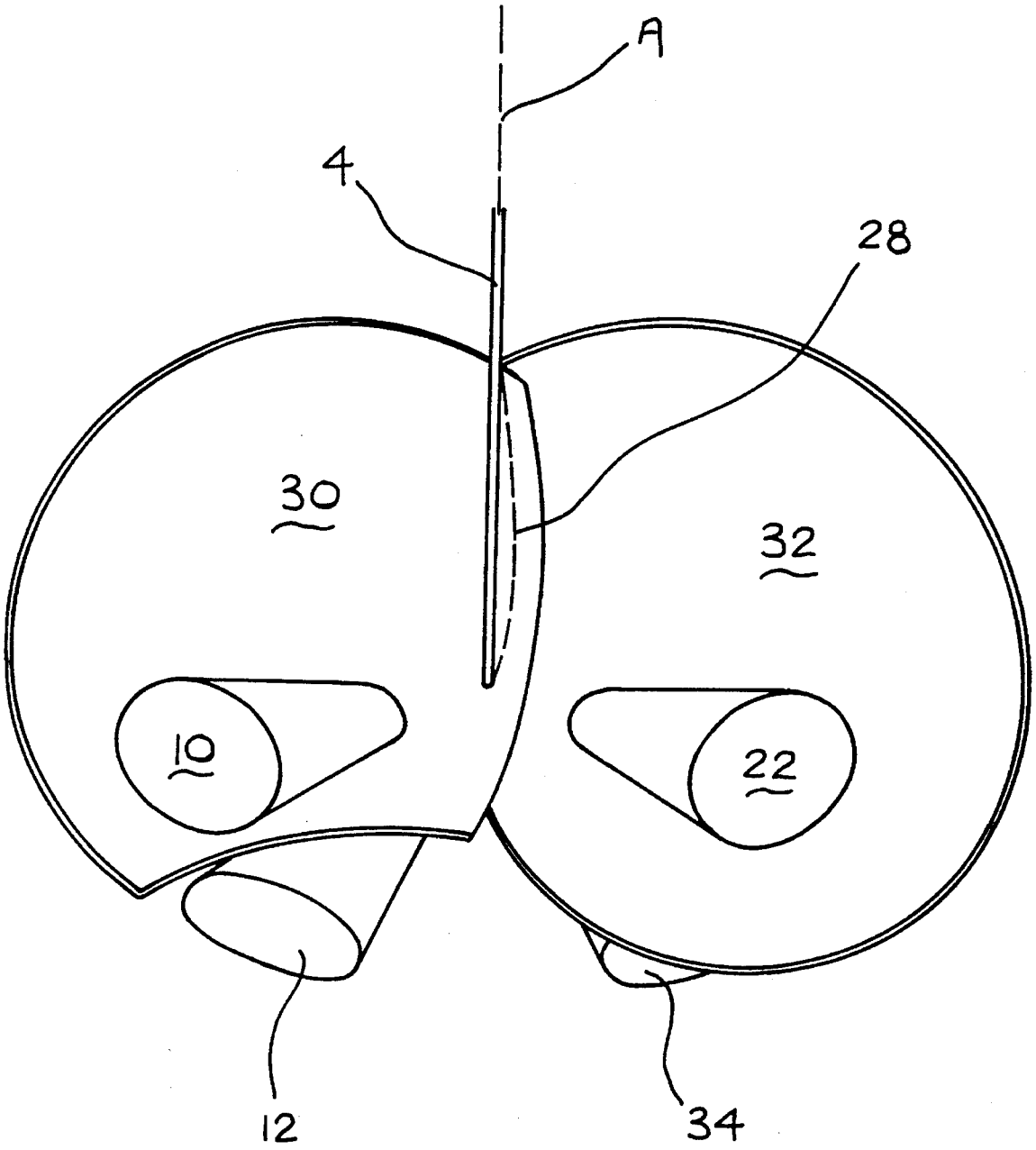
FIG. 2 is a schematic perspective view from the in-feed side of the sewing machine, showing two workpiece portions clamped between workpiece support means and workpiece clamping means of the apparatus, whilst being fed to the needle of the sewing machine during stitching of the workpiece portions.

FIG. 2 illustrates schematically how the two sets of rollers 10, 12 and 22, 34 engage two workpiece portions 30, 32 that are to be sewn together by the needle 4. The two workpiece portions 30, 32 would typically be shoe upper components that, when sewn together, are to form a three-dimensional construction, but may alternatively comprise two portions of a single shoe component to be closed by stitching.

With reference to FIG. 3, the two workpiece portions 30, 32, each having a selected (hereinafter "stitching") region 24, 26 which must be conformed respectively to the stitching path 28, are shown partially sewn together by the needle 4. (In FIG. 3 one stitching region is denoted by a row of dots and the other by a row of xs.) The shapes of the workpiece portions 30, 32 are such that when the portions are in a substantially flat condition, the stitching regions 24, 26 do not overlap along the whole of their length; this can be seen in FIG. 3 from the fact that the stitching regions 24, 26 diverge at the in-feed side of the needle 4, adjacent the rollers 10, 12, 22, 34. The stitching regions 24, 26 are each spaced by a known distance from the edge of the respective workpiece portions 30, 32.

As the stitching regions 24, 26 do not overlap, in order to stitch the workpiece portions together along the desired stitching path 28 they must first be distorted so as to force the stitching regions 24, 26 into an overlapping relationship in advance of the needle 4. To this end, the rollers 10, 12, 22, 34 co-operate to rotate the workpiece portions 30, 32 relative to one another, about an axis designated S coincident with the point of intersection of the roller axes, sufficiently to bring the stitching regions 24, 26 into the desired overlapping relationship.

In the apparatus now being described this axis is coincident with the axis of reciprocation A of the needle 4 while the latter remains in penetrating engagement with the workpiece portions at the last-formed stitch point (as shown in FIG. 3). When each set of rollers is in engagement with its respective workpiece portion, rotating the rollers thus has the effect of rotating said portion about the axis S, which is also the nearest point to the rollers at which the workpiece portions are secured together. In effect, therefore, the portions 30, 32 are rotated about the last-formed stitch point. Simultaneously rotating the workpiece portions thus results in the unstitched stitching regions 24, 26 being urged into their desired overlapping relationship, progressively for each stitch formation, by transverse movement thereof, i.e. left or right as viewed in FIG. 3, with respect to the workpiece feed direction F. Once transverse movement of the workpiece portions 30, 32 has taken place and the stitching regions 24, 26 have been forced into their desired overlapping relationship rotation of the rollers ceases. The workpiece portions 30, 32 are then held clamped in position during rotation of the needle 4 and the advancing of the workpiece portions 30, 32 to bring the next stitch joint to coincidence with the axis of reciprocation A of the needle. The process is then repeated until the two workpiece portions 30, 32 are sewn together along the whole of the stitching path 28.

Figure 4:
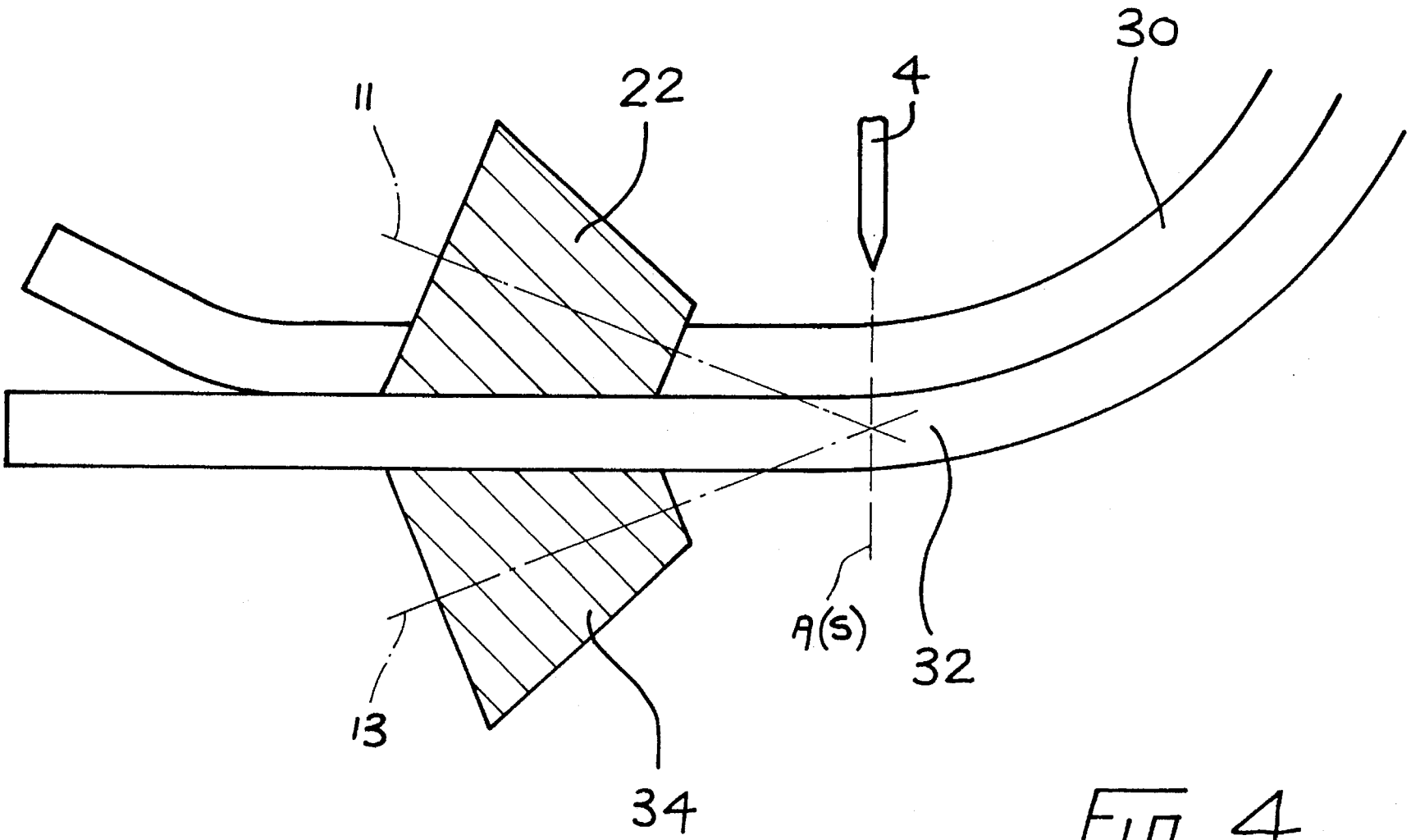
FIG. 4 is a schematic side view of the arrangement shown in FIG. 3.

FIG. 4 shows the effect that is achieved by sewing the workpiece portions 30, 32, producing a three-dimensional form from the initially two-dimensional portions. As can be seen in FIG. 4, the distortion of the workpiece portions 30, 32 causes them, when sewn, to "curl upwards" beyond the needle 4.

Figure 5:
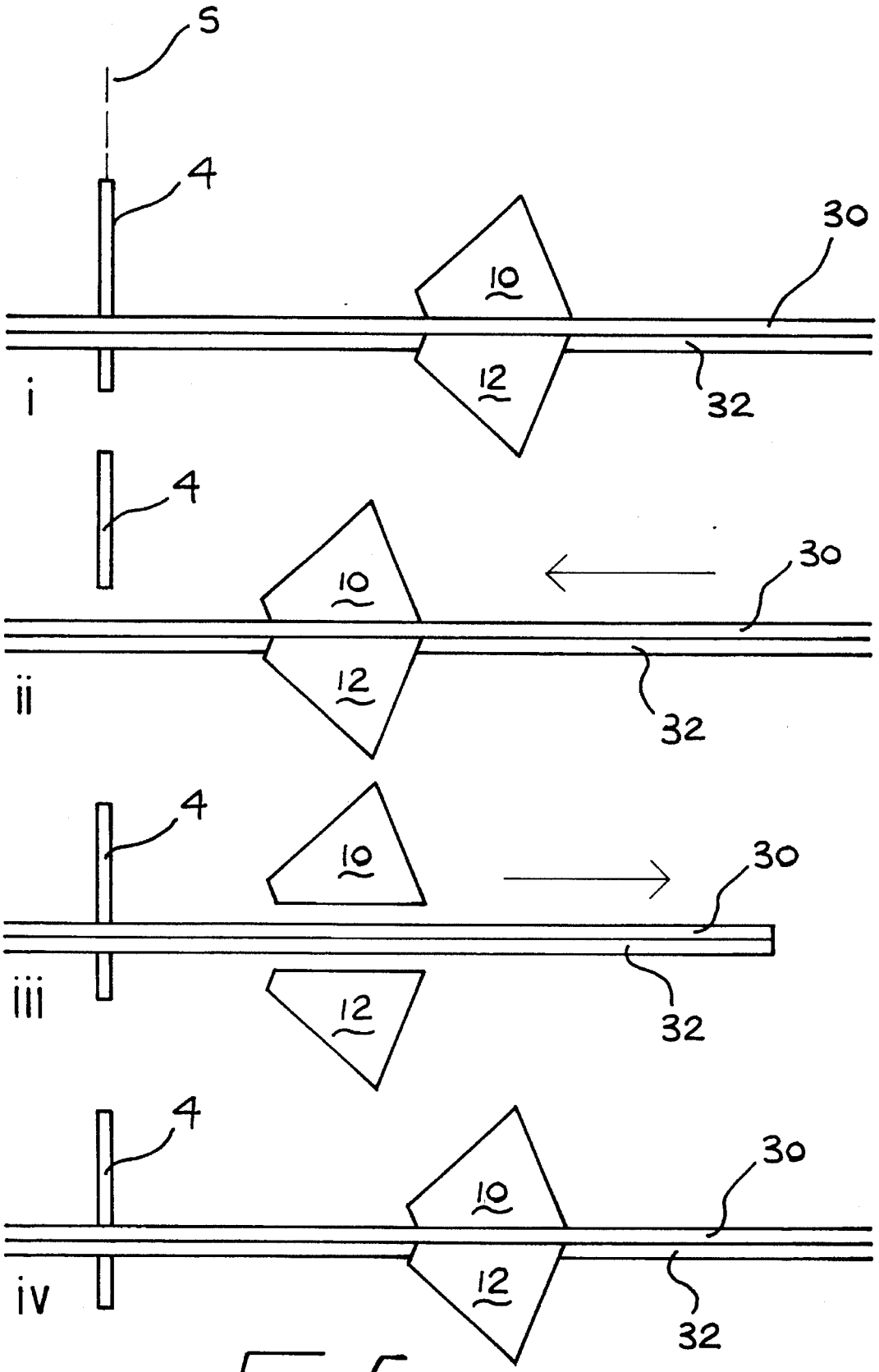
FIG. 5 is a series of schematic side views illustrating a sequence of steps in the operation of the apparatus.

FIG. 5 shows a sequence of operating steps designated a to d, by which one (30) of the workpiece portions is fed to the needle 4. The same sequence is followed by the other portion 32. As depicted in step a, the workpiece portion is clamped by the rollers 10, 12. At this time the needle 4 is in penetrating engagement with the workpiece portion 30 (and thus the axes A and S are coincident). Whilst the workpiece portion 30 is thus clamped, the roller 10 is rotated so as to rotate the portion 30 about the axis S and the other portion 32 is similarly rotated until the stitching regions 24 thereof are, so far as concerns the next stitch point, in the desired overlapping relationship. The support rollers 12, 34 rotate freely with the workpiece portions 30, 32.

In step b the needle 4 is withdrawn from the workpiece portions 30, 32 and thereafter the rollers 10, 12, 22, 34 are advanced by the action of the motors 54, 56 through one stitch length, while the portions 30, 32 remain clamped in said relationship.

In step c the next stitch is formed by the needle again penetrating the workpiece portions 30, 32 and, following such penetration, the rollers 10, 12, 22, 34 are simultaneously disengaged from the workpiece portions 30, 32 by the upper carriage 18 being raised relative to the support 50 and are returned to the initial position under the action of motors 54, 56.

In step d the rollers 10, 12, 22, 34 are again moved into engagement with the workpiece portions 30, 32 by lowering the upper carriage 18 relative to the support 50 and thus are again in operative position.

The cyclical process until the stitching of the workpiece portions 30, 32 is completed along the whole of stitching path 28.

Figure 6:
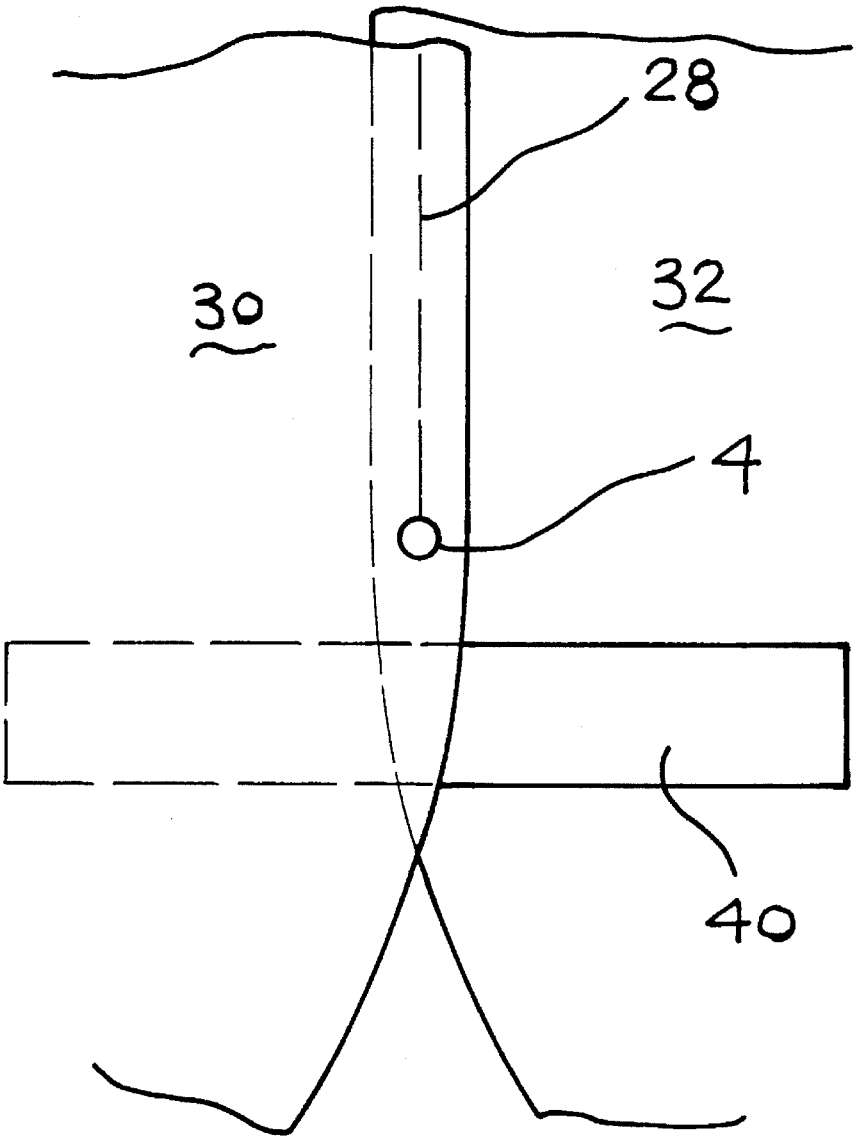
FIG. 6 is a schematic partial plan view illustrating sensing means of the apparatus, more particularly the positioning of a reflective sensor plate thereof between two workpiece portions to be sewn.
Figure 7:
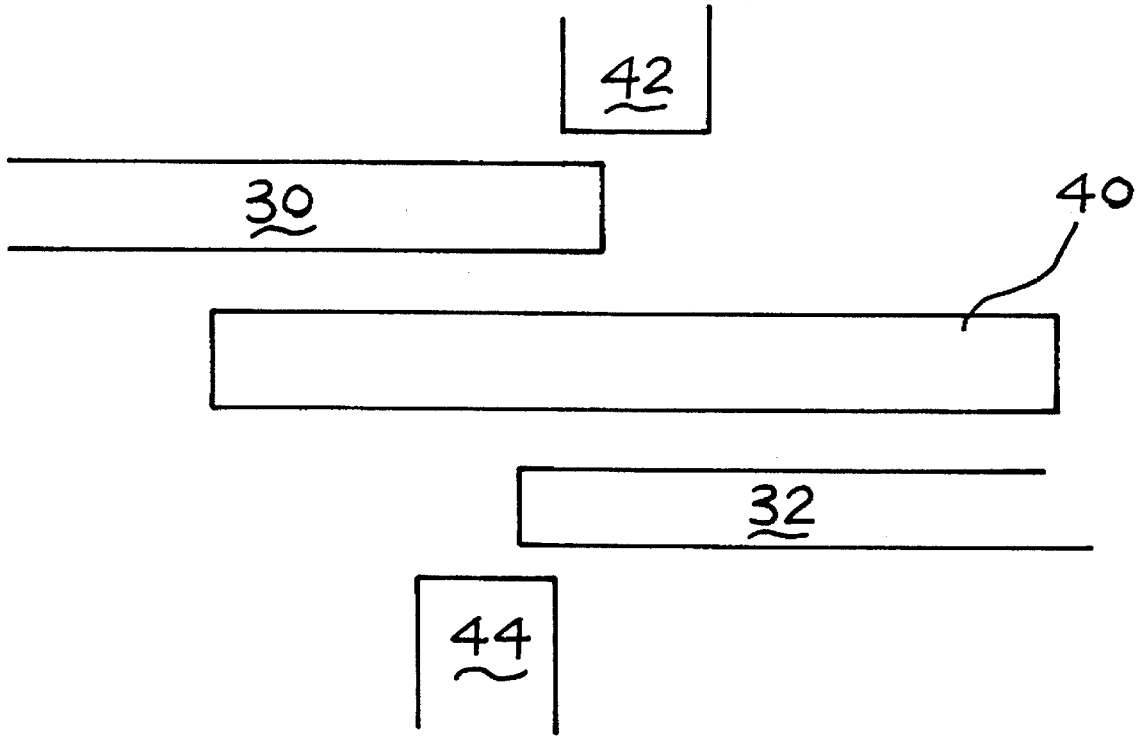
FIG. 7 is a schematic view illustrating the relationship between the sensing means and the workpiece portions in the operation of the apparatus.

For controlling the movement of the workpiece portions 30, 32 in order to align the stitching regions 24, 26 in the desired overlapping relationship the apparatus in accordance with the invention further comprises sensor means (FIG. 6 and 7). The sensor means controls the operation of the stepper motors 52 that rotate the rollers 10, 22 by sensing the position of the edge of each workpiece portion 30, 32. (As already mentioned, each stitching region 24, 26 of each workpiece portion is a known distance away from such edge.) The sensor means comprises a reflective sensor plate 40, which is accommodated between the two workpiece portions 30, 32 but projects from between them, in advance of the needle 4, more particularly in the region of the next-following stitch points, together with two sensors 42, 44, one associated with each of the projecting portions of the plate 40. Each of the sensors 42, 44 is located at the opposite side of the workpiece portion, whose edge is to be sensed thereby, to the reflective sensor plate 40. Each sensor 42, 44 contains a light emitter and receiver. Light is emitted from the sensor 42, 44 and reflected by the reflective plate 40 to the receiver, so long as the path from the sensor 42, 44 to the reflective plate is not interrupted by the workpiece portion. In the event of interruption of the light from the sensor 42 or 44 to the reflective plate 40, a signal is generated in response to which the appropriate motor 52 is caused to cease operation and is associate roller 10, 22 thus ceases rotation. By way of example, in the case of the portion 30, the rotation of the roller 10 may produce a movement of the portion from left to right (viewing FIGS. 6 and 7). The sensor 40 is so positioned that the path between the emitter and the reflective plate 40 is interrupted when the portion 30 has moved a sufficient distance to the right, that is, when the portion 30 has reached a position in which it will be in the desired overlapping relationship with the other portion 32 when the latter has been moved similarly. Once the light from the emitter to the reflective plate 40 has been interrupted, lateral movement of the portion 30 under the action of motor 52 ceases. Sometimes, it will be appreciated, the workpiece portion may already be interrupting the light, in which case movement in the opposite direction will be necessary. In such case the portion will be moved until the light just ceases to be so interrupted.

Whereas the invention has been described above with specific reference to a sewing machine, it will be appreciated that it is also applicable in other cases where workpiece portions are advanced progressively to an operating locality, whether step-by-step or continuously, e.g. a machine for securing workpiece portions together by means of adhesive.

We claim:

1. Workpiece positioning apparatus for positioning two workpiece portions with selected regions thereof in a desired relationship and for progressively advancing said two workpiece portions, in said relationship, through an operating locality of a machine by which said selected regions are progressively treated, said apparatus comprising:

workpiece support means for supporting said workpiece portions;

workpiece clamping means in cooperative association with said workpiece support means for clamping said workpiece portions in said desired relationship; and advancing means for advancing said workpiece portions, clamped in said relationship, along a desired path through said operating locality;

characterized in that, for enabling workpiece portions to be treated having selected regions which cannot be aligned with one another along their entire length when said portions are in a substantially flat condition, said workpiece clamping means comprises two elements, each of said elements engageable with a respective one of said workpiece portions in such a way that action of each element upon its respective workpiece portion, while that workpiece portion remains clamped by said clamping means, effects movement of that workpiece portion rotatively about said operating locality and transversely of said path, thus bringing said two workpiece regions progressively into said desired relationship at said operating locality;

and in that drive means is provided for effecting said action of said elements.

2. Apparatus according to claim 1 characterised in that each element of the workpiece clamping means is constituted by a conical roller rotatable about an axis, and in that the two axes intersect with each other at said operating locality.

3. Apparatus according to claim 2 characterized in that said workpiece support means comprises two conical rollers, one workpiece support means conical roller associated with each of said workpiece clamping means conical rollers, each workpiece support means conical roller being rotatable about an axis, and in that said workpiece support means roller axes intersect with each other and with said workpiece clamping means roller axes at said operating locality.

4. Workpiece positioning apparatus whereby two workpiece portions are positioned with selected regions thereof in an overlapping relationship and are progressively advanced, in said relationship, through an operating locality of a sewing machine, at which said locality a reciprocable needle of said sewing machine is located for effecting a progressive sewing operation along said workpiece regions, said apparatus comprising:

workpiece support means for supporting said workpiece portions;

workpiece clamping means in cooperative association with said workpiece support means for clamping said workpiece portions in said overlapping relationship; and advancing means for advancing said workpiece portions, clamped in said relationship, along a desired path through said operating locality;

characterized in that, for enabling workpiece portions to be sewn having selected regions which cannot be overlapped with one another along their entire length when said portions are in a substantially flat condition, said workpiece clamping means comprises two elements, each of said elements engageable with a respective one of said workpiece portions in such a way that action of each element upon its respective workpiece portion, while that workpiece portion remains clamped by said clamping means, effects movement of that workpiece portion rotatively about said operating locality and transversely of said path, thus bringing said two workpiece regions progressively into said overlapping relationship at said operating locality;

and in that drive means is provided for effecting said action of said elements.

5. Apparatus according to claim 4 characterized in that said drive means and said advancing means are alternately actuated in timed relation with reciprocation of said needle so that transverse movement of said workpiece portions is effected while said needle is in penetrating engagement therewith, and said workpiece portions are advanced while said needle is out of penetrating engagement therewith.

6. Apparatus according to claim 5 characterized in that said workpiece support means and said workpiece clamping means are mounted for movement towards and away from one another, so that said workpiece portions disposed therebetween are clamped therebetween and unclamped, and in that said workpiece support means and said workpiece clamping means are also mounted each on a carriage, for advancing and return movement in a direction along said path, said advancing movement being effected with said workpiece portions clamped, thus to cause them to be advanced, and said return movement being effected with said workpiece portions unclamped but with said needle in penetrating engagement therewith.

7. Apparatus according to claim 6 characterised in that the rollers of the workpiece support means are freely rotatable.

8. Apparatus according to claim 4 characterised in that each element of the workpiece clamping means is constituted by a conical roller rotatable about an axis, and in that the two axes intersect with each other and with an axis (A) along which the needle reciprocates.

9. Apparatus according to claim 8 characterized in that said workpiece support means comprises two conical rollers, one workpiece support means conical roller associated with each of said workpiece clamping means conical rollers, each workpiece support means conical roller being rotatable about an axis, and in that said workpiece support means roller axes intersect with each other and with said workpiece clamping means roller axes and with the axis along which said needle reciprocates.

10. Apparatus according to claim 4 further characterized by sensing means for detecting edges of said workpiece portions, said sensing means controlling operation of said drive means so that under the control of said sensing means said workpiece portion selected regions are brought progressively into said overlapping relationship.

11. Apparatus according to claim 10 characterized in that said sensing means comprises a plate member interposed between, but not projecting from between, each of said workpiece portions upstream of said operating locality, which plate member has a surface reflectivity different from that of said workpiece portions, and two emitter receivers, one associated with each of said workpiece portions, in cooperative association with projecting portions of said plate member to enable said workpiece portion edges to be detected thereby.

* * * * *